United States Patent [19]

McNamara

[11] Patent Number: 4,885,813

[45] Date of Patent: Dec. 12, 1989

[54] FOLDING HEADBOARD FOR FOLDING BED

[75] Inventor: George McNamara, Minneapolis, Minn.

[73] Assignee: Sico Incorporated, Minneapolis, Minn.

[21] Appl. No.: 159,892

[22] Filed: Feb. 24, 1988

[51] Int. Cl.[4] ..... A47C 19/02

[52] U.S. Cl. ..... 5/136; 5/159 R

[58] Field of Search ..... 5/133, 136, 159, 411, 5/412, 53 R

[56] References Cited

U.S. PATENT DOCUMENTS

| | | | |
|---|---|---|---|
| 348,643 | 9/1886 | Strahan | 5/136 |
| 485,159 | 11/1892 | Alexander | 5/133 |
| 734,363 | 7/1903 | Pyle | 5/159 R |
| 2,067,136 | 1/1937 | Bridenbaugh | 5/133 |
| 3,464,070 | 9/1969 | Driver | 5/136 |
| 3,550,167 | 12/1970 | Bennett | 5/136 |

*Primary Examiner*—Gary L. Smith
*Assistant Examiner*—Michael J. Milano
*Attorney, Agent, or Firm*—Merchant, Gould, Smith, Edell, Welter & Schmidt

[57] ABSTRACT

An automatic folding headboard for a folding wallbed functions, when the bed is in its horizontal use position, to cover the recess in the wall or cabinet into which the bed folds. The headboard automatically folds to a storage position in response to movement of the bed to its vertical storage position, without the need for separate mechanical actuators or manual operations by the operator. The headboard assembly is selectively releasable to provide access to the hinge mechanism for the bed.

5 Claims, 5 Drawing Sheets

FOLDING HEADBOARD FOR FOLDING BED

FIELD OF THE INVENTION

This invention pertains to the field of folding beds, sometimes referred to as wall beds, which are adapted to be folded from a generally horizontal use position in a room, to a generally vertical storage position in a cabinet or wall recess in order to provide more space when the bed is not needed. In particular, the invention pertains to an improved folding headboard for a folding wall bed, which automatically folds to a compact storage position as the bed is folded into the wall or cabinet, and which automatically unfolds as the bed is folded to its horizontal position, to provide a finished appearance over the opening in the cabinet or wall and to help conceal the bed hinge mechanism from the room.

BACKGROUND OF THE PRIOR ART

Folding wall beds are widely used, for example, in multi-purpose hotel rooms, efficiency apartments and housing units for the elderly, in order to make more efficient use of available floor space. In hotels, the use of wall beds allows rooms to be configured either as regular sleeping rooms or as conference rooms, by simply folding up the bed and bringing in a table, or perhaps folding out a compact folding table. The term folding wall bed, or simply wall bed, will be used in this patent application to include all such beds regardless of whether they fold adjacent a wall, to a recess formed in the wall, or into a cabinet formed in or positioned adjacent a wall. In any case folding wall beds typically have hinge mechanisms, counterbalance springs and the like connecting the bed frame to the floor or wall, generally adjacent the head portion of the bed. In some designs, headboards have been provided to at least partially cover the recess into which the bed folds and thereby to cover or hide the folding and counterbalancing mechanism, not only for aesthetic reasons but also to protect the occupants in the room from mechanical hinge parts which may be greasy and which may in some cases represent potential danger due to moving parts.

Although various types of folding headboards have been proposed in the prior art, in order to be successful from the point of view of ease of manufacture and installation and convenience in use, it is believed that a folding headboard should provide certain features and advantages. The headboard should not require a separate folding/unfolding sequence of steps over and above the steps for folding/unfolding the bed. Separate operations are inconvenient for the user, and might lead to the potential for damage to the mechanism, depending upon the specific design, in case the operator forgets to tend to the folding/unfolding of the headboard prior to the bed. Ideally, a headboard should substantially fully cover the recess which contains the hinge and folding mechanism for the bed, while at the same time providing a means for gaining access to the recess area for servicing the mechanism or for retrieving objects inadvertently dropped behind the bed. The headboard should also be simple in terms of the number and assembly of parts so as to avoid elaborate mechanisms with numerous actuators and parts which would increase the cost not only in terms of manufacturing, but also in terms of installation and adjustment at the time the bed is installed.

SUMMARY OF THE INVENTION

This invention overcomes the above-noted shortcomings of prior art folding headboards, by providing a folding headboard that is automatic in operation, simply to manufacture and assemble, which substantially closes off the wall recess in which the hinge mechanism is mounted to thereby provide a finished appearance for the installation, and yet which provides easy service access to the hinge and counterbalance mechanisms, or to retrieve objects such as pencils and the like which may have fallen behind the bed.

DETAILED DESCRIPTION OF THE PREFERRED EMBODIMENT

Figure 1:
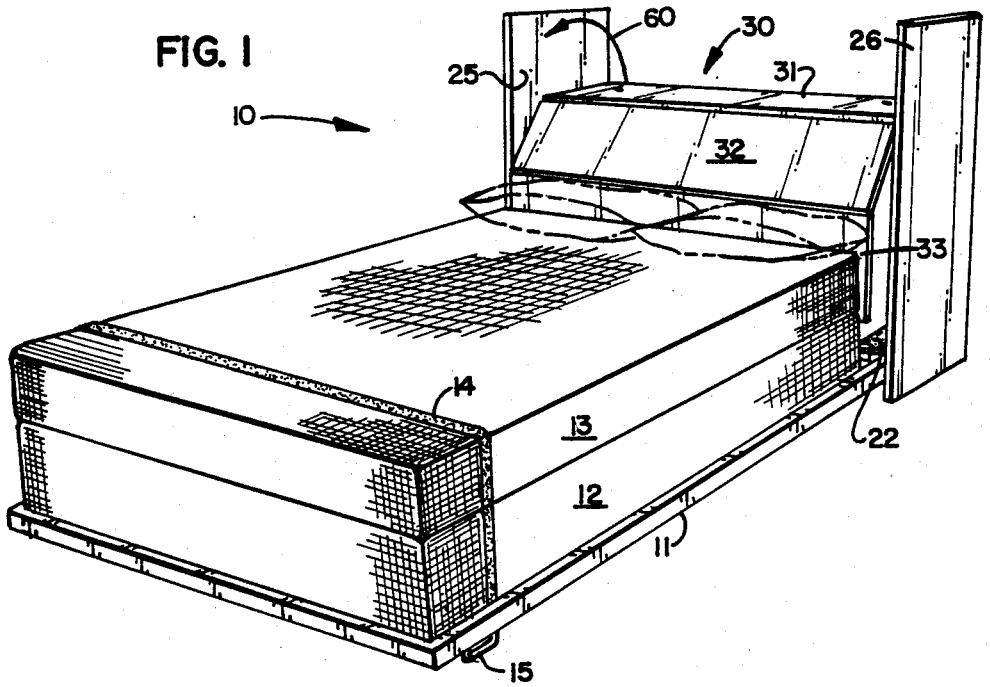
FIG. 1 is a perspective view of a folding bed in its horizontal, use position, which is equipped with the automatic folding headboard of the present invention.

The preferred embodiment of the invention will now be explained with reference to the various figures of the drawing, in which the same parts carry identical reference numbers throughout the various figures. The automatic headboard of the present invention is shown as applied to a counterbalanced folding bed of the type generally disclosed in U.S. Pat. No. 3,999,245, assigned to the same assignee as the present invention. However, it will be understood that the invention could be applied as well to other types of folding beds.

The folding bed is generally referred to by reference number 10, and the automatic folding headboard is generally referred to by reference number 30. Bed 10 includes a rectangular frame 11 which supports box spring 12 and mattress 13 thereon. A strap 14 may be provided as generally known for securing these items to frame 11. Frame 11 is the moveable frame portion of the bed, in that it moves the bed between the horizontal use position of FIG. 1 and the vertical storage position of FIG. 8. In the horizontal use position of FIG. 1 and 3, the outer end or foot of the bed rests on handles 15 which provide the dual function of supporting the end of the bed in the use position, and providing a means for pulling the bed from the vertical storage position.

Adjacent the head of the bed, that is, the end of the bed nearest the wall recess, is a hinge and counterbalance mechanism as is more clearly shown in above-mentioned U.S. Pat. No. 3,999,245. Specifically, moveable frame 11 is pivotally connected at pivot 16 to a fixed or base frame member. The fixed or base frame member may be secured to a mounting board 21, which in turn is secured to the floor or cabinet to which the bed is attached. A pair of counterbalance mechanisms, indicated by reference number 22 are provided. These mechanisms include springs constrained within cylinders and applying force to cables passing over cams about the pivot points 16, in accordance with the teaching of the above-mentioned patent. Together they provide a counterbalancing force for the weight of the bed, so that the physical effort required of an operator to move the bed between the use and storage positions and vice versa is at a minimum.

Vertical sideboards 25, 26 are also provided. These are shown as separate boards in the drawings, but it will be appreciated that they could be part of, or attached to, an overall cabinet designed to receive the bed in its storage position. Alternatively, vertical sideboards 25, 26 could be positioned in a recess in a wall, or their functions could be provided by the side walls of the recess itself. Vertical sideboards 25, 26 rest on the floor at either side of the head of the bed, and are held in position by means (not shown) such as attachment as part of a mounting cabinet, attachment within a recess and a wall, or alternatively by cross boards attached between the two vertical sideboards at the back sides thereof (not shown).

The headboard assembly 30 consists of three separate board members 31, 32, 33, hinged together. For convenience of terminology, boards 31, 32 and, 33 are referred to herein as the top, middle and lower boards, respectively. It will be appreciated, however, that these terms are arbitrary and other terms could be used. Boards 31, 32 and 33 are substantially the width of the bed and tit with clearance between vertical sideboards 25 and 26. Top board 31 and middle board 32 are hinged together as shown by a number of common hinge brackets 34. Similarly, the lower edge of middle board 32 is secured by hinges 35 to the upper edge of lower board 33. Hinge connection 34 is preferably offset slightly, as can be seen for example in FIG. 8, so that top board 31 and middle board 32 are not quite coplanar when the bed is in its vertical storage position, but are already at a slight angle to one another. This aids in the proper folding of hinge 34 upon initial movement from the bed from the storage position.

Lower board 33 is secured to moveable frame member 11, for example to vertical uprights 17 which are secured to and form a part of moveable frame 11.

Figure 2:
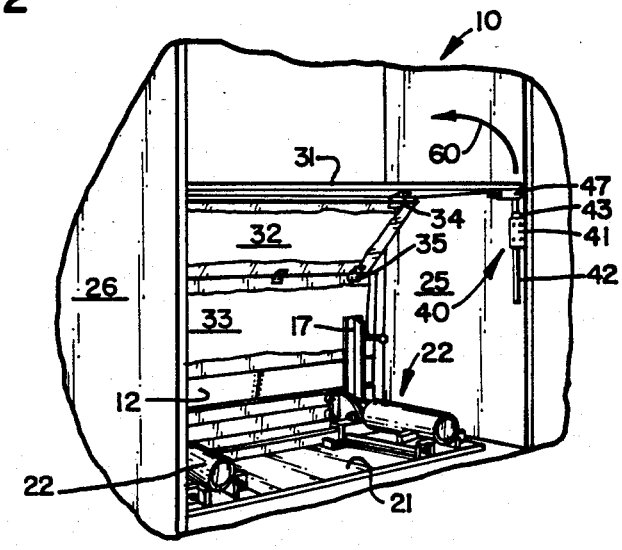
FIG. 2 is a view in perspective from behind the bed of FIG. 1, showing the recess behind the headboard where the hinge and counterbalance mechanism is positioned.

A pair of motion control mechanisms connect between the vertical sideboards and the adjacent edges of top board 31 to support board 31 in the use position and to help guide the headboard assembly to and from the storage position. In the preferred embodiment the motion control mechanisms are in the form of slide rod mechanisms. Slide rod mechanism 40 is seen in FIG. 2 and is shown in greater detail in FIG. 10. This mechanism is positioned at the righthand end of top board 31 and at vertical sideboard 25. A similar (but reversed) slide rod mechanism (not shown) is provided at the lefthand end of top board 31 and vertical sideboard 26.

A sleeve 41 is secured generally along the rearward edge of vertical sideboard 25. Sleeve 41 has a central bore positioned vertically to receive one end of a slide rod 42. Slide rod 42 is bent at a 90° angle. One portion is slideably received in sleeve 41. A stop collar 43 is provided to adjust the lowest position rod 42 can go with respect of sleeve 41. This is used to adjust the final angle of top member 31. The other end of rod 42 is received in a release bracket 45. Bracket 45 is secured to the underside of top member 31 near its rear edge. It is designed to receive the end of rod 42 in such a manner top board 31 is secured to and supported by rod 42, with pivotal motion of bracket 45 about rod 42 taking place during the folding/unfolding operations. In special circumstances release bracket 45 can be opened to swing away from rod 42, as explained further below.

It is important to note that while slide rod mechanism 40 helps control the motion of the headboard assembly during folding/unfolding, its operation is self regulating and automatic, in response to the basic folding or unfolding of the bed. No separate user actuation is required, and no separate linkage is required between the slide rod mechanism and the bed hinge mechanism, as the folding force is applied through the headboard assembly itself.

In the use position of the bed, as seen in FIG. 1, headboard assembly 30 provides a finished appearance which hides the recess containing the hinge and counterbalance mechanism. This prevents objects such as the pillows or bedding from falling down behind the head of the bed and getting greasy or snagged on the mechanism. Also, by normally preventing access to the hinge mechanism area, it helps reduce the potential for injury. Top board 31 can be positioned horizontally, and thus can serve as a temporary shelf. However, this shelf disappears when the bed is folded, and in order to discourage people from placing objects on it, it can be raised to a angled position. This is done simply by raising the back edge of top board 31 and moving collar 43 to a lower desired stop position on slide rod mechanism 40, after which it is secured by its set screw. The collar then holds board 31 at a tilt or slope.

Figure 6:
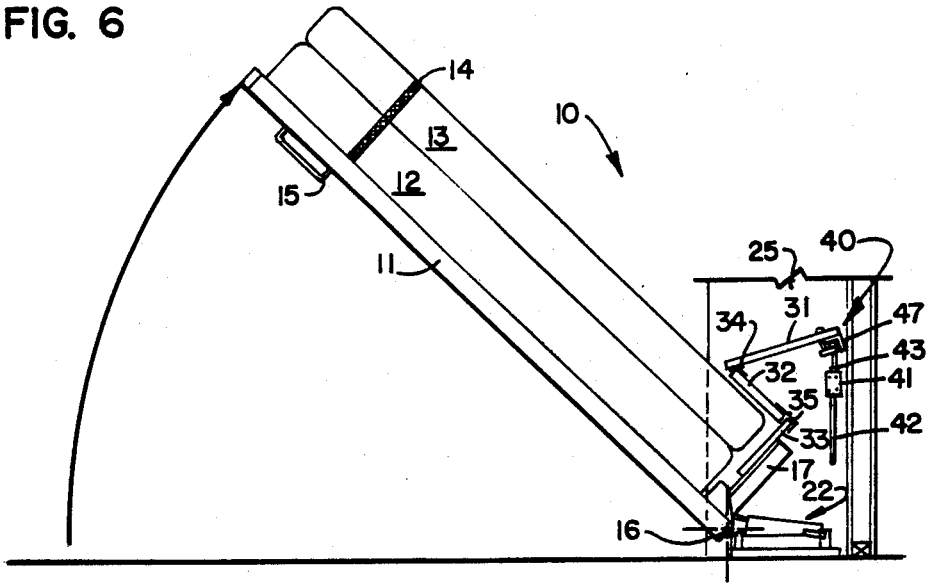
Figure 7:
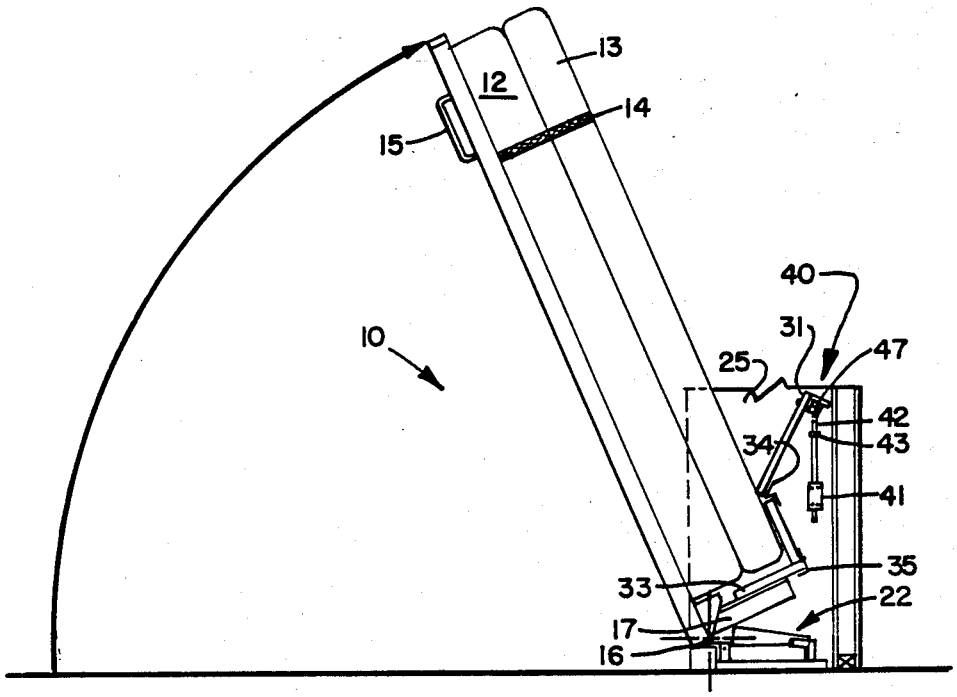

In normal operation, the headboard assembly 30 folds in response to folding up of the bed as indicated in the sequence of FIGS. 3–8. The swinging of bed frame 11 about pivot 16 causes initial movement of hinge 35 towards the back wall. Further movement of the bed places middle board 32 at approximately right angles to bottom board 33 (FIG. 6). Further movement of the bed towards the vertical storage position attempts to push top board upwardly and inwardly, and rods 42 slide upwardly in sleeves 41 to accomodate this movement, as shown in FIG. 7. Subsequent movement from FIG. 7 to the full storage position of FIG. 8 pulls rods 42 downwardly from their peak position at FIG. 7, and top board 31 rests against the mattress.

Figure 3:
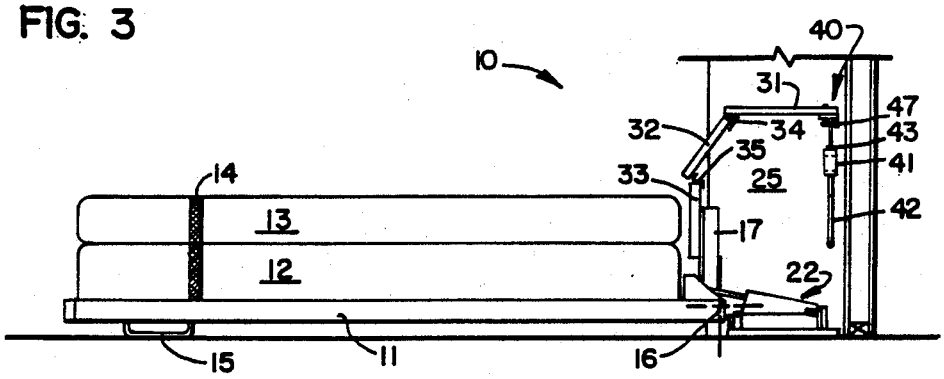
FIG. 3 is a cross-sectional view of the bed assembly of FIG. 1 showing the bed and headboard in the use position.
Figure 4:
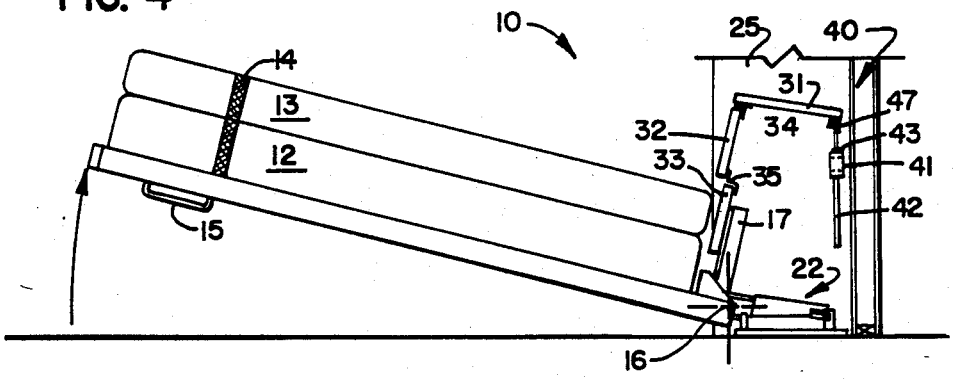
FIGS. 4-7 are sectional views similar to FIG. 3 showing the bed and automatic headboard in progressive stages of folding toward the storage position.
Figure 5:
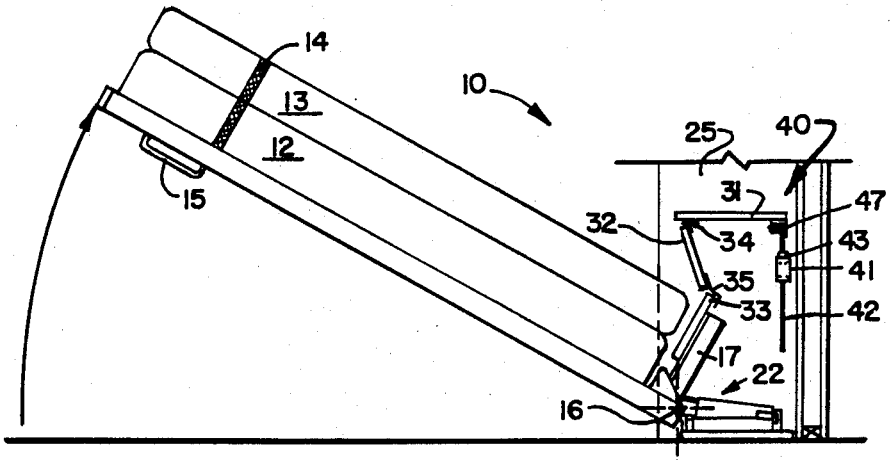
Figure 8:
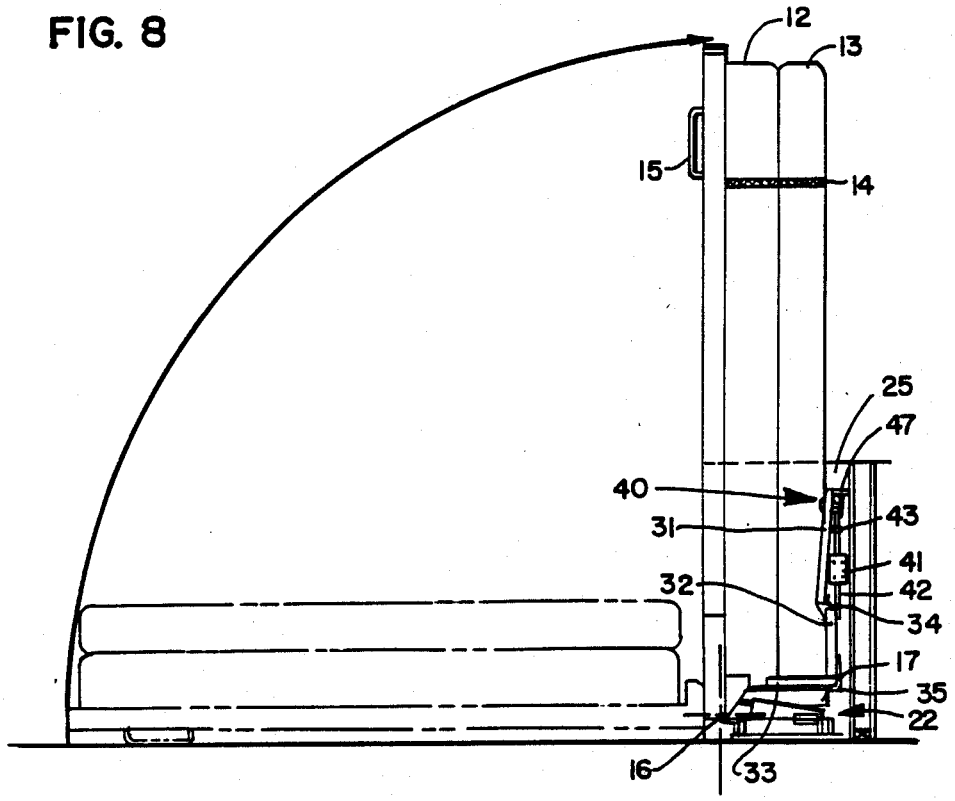
FIG. 8 is a view similar to FIG. 3 showing, in solid line, the bed and headboard folded to the vertical storage position, and in broken line, the bed in the use position.

Moving the bed from the storage position of FIG. 8 to the horizontal use position of FIG. 3 reverses the sequence just described, with slide rod 42 initially moving up towards the peak position of FIG. 7, and thereafter moving down as the bed moves to the use position and boards 31 and 32 are pulled away from their storage position adjacent the mattress and into the position shown in FIG. 1. As previously mentioned, the slight offset in the positioning of the edges of top board 31 and middle board 32 causes them to be at a slight angle to one another, which aids in the initial movement of the bed from the storage position.

It is sometimes necessary to gain access to the counterbalance and hinge mechanism. For example, qualified service personnel may need to gain access for inspection or maintenance, or hotel personnel may need to gain access to retrieve small objects such as pencils which may have dropped behind the headboard assembly, or between it and vertical side boards 25, 26. By releasing the release brackets 45 at either end of the top board 31, board 31 can be pivoted as indicated by arrows 60 in FIG. 1 and 2, to gain access to the recess behind the bed. Specifically, the back end of top board 31 can be swung up, and the front end pivots about its normal pivotal connection to the edge of middle board 32.

Figure 9:
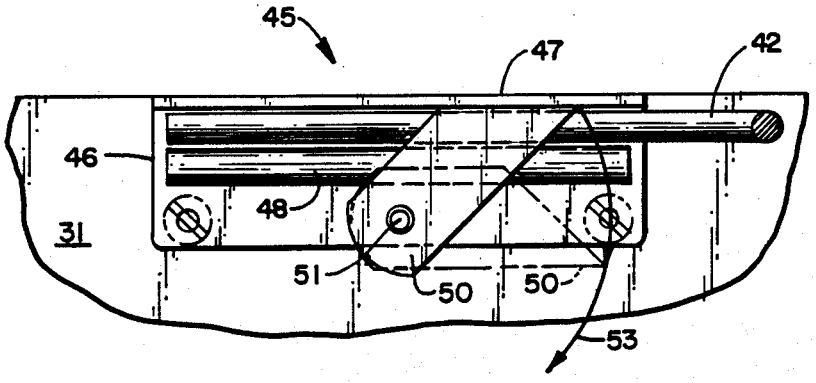
FIG. 9 is a detail at an enlarged scale of a release mechanism used in the present invention.
Figure 10:
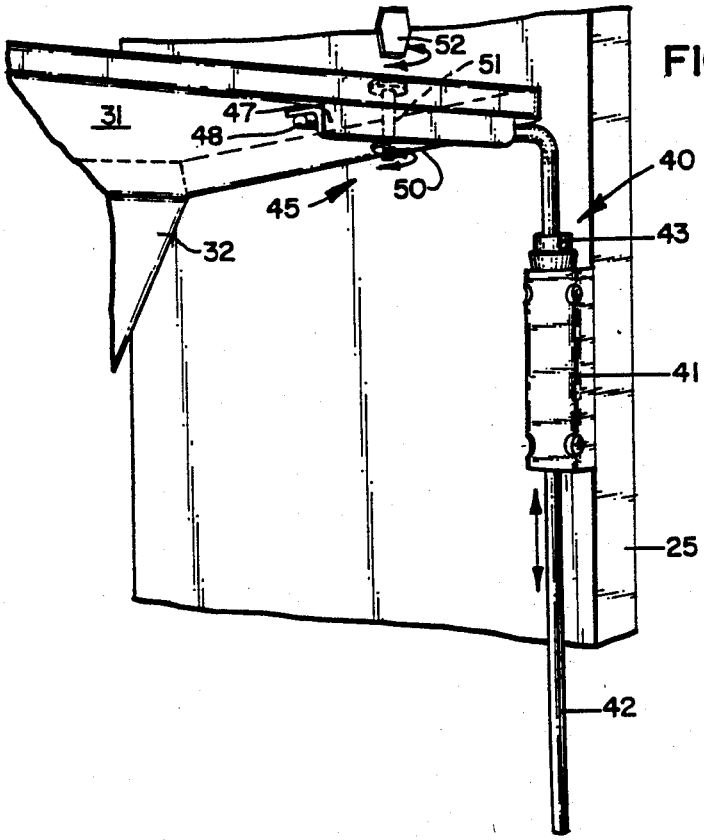
FIG. 10 a view in perspective of a portion of the mechanism which controls the motion of the headboard during folding.

As seen in FIGS. 9 and 10, release bracket 45 in the preferred embodiment includes an angle bracket having a base portion 46 secured by suitable means, for example bolts or screws, to the underside of top member 31 adjacent its rearward edge. Bracket 45 also includes a flange portion 47 which, together with a raised guide portion 48 which is parallel to flange 47, serves to define a channel for receiving the end of rod 42. Rod 42 is permitted to rotate about its axis within the channel thus formed, but is normally prevented from moving from the channel by a keeper plate 50. The outer end of keeper plate 50 is bevelled to match the angle of the edge of the board, and its other end is attached to the tip of a pivot bolt or screw 51 which passes through the board to the keeper plate. The screw 51 can be accessed from the top side of top board 31 and rotated by a screwdriver 52. To open the headboard assembly, screwdriver 52 is inserted to turn pivot screw 51, causing keeper plate 50 to rotate out of the way as indicated by arrow 53. After the same is done to the release mechanism on the opposite end of top board 31, it can be swung away from the slide rod 42, allowing access to the hinge mechanism recess. Reassembly is by the reverse of the above-described procedure.

Alternatively, if it is desired to make access more difficult for persons other than service personnel, pivot bolt 51 can be provided with a hex head so that a special hex key would be needed. It will be appreciated that other types of pivotable release mechanisms could be used in place of release bracket 45 shown in the preferred embodiment.

As described above, this invention provides an improved automatically folding headboard assembly for a folding bed which is simple to manufacture and install and automatic and convenient in use.

What is claimed is:

1. An automatic folding headboard for a folding bed which includes a fixed frame for mounting in a wall recess or cabinet and a moveable frame pivotally connected to said fixed frame for permitting movement of the bed from a horizontal use position in the room to a vertical storage position in the wall recess or cabinet, said headboard comprising:

first, second and third headboard members;

hinge means connecting adjacent edges of said first and second board members, and adjacent edges of said second and third board members;

means for securing the first board member to the moveable frame at the head of the bed;

motion control means for supporting said third board member with respect to the side walls of said wall recess or cabinet to form a three-part hinged headboard substantially covering the lower portion of said wall recess or cabinet in which said fixed frame and pivot are mounted, wherein said third headboard member forms a shelf when the bed is in its horizontal use position, and wherein said second and third headboard members fold into a substantially vertical position and said first headboard member folds to a substantially horizontal position when said folding bed is folded into the vertical storage position; and said motion control means configured for guiding and permitting controlled motion of the rear edge of said third board member as said bed is moved between horizontal and vertical positions so that the hinged board members can automatically move to a folded storage position as the bed is moved to its vertical storage position.

2. Apparatus according to claim 1 wherein said motion control means includes means attaching to the side walls of said wall recess or cabinet and configured to permit limited vertical motion of the rear edge of said third board member, and wherein said third board member is pivotally connected to said motion control means.

3. Apparatus according to claim 1 wherein said motion control means s selectively releasable to permit disengagement of said third board member therefrom so that said hinged headboard can be moved away from said wall recess or cabinet with the bed in its horizontal position, to permit access thereto.

4. Apparatus according to claim 1, wherein said motion control means is adjustably connected to said third headboard member for selectively adjusting the position of said shelf.

5. Apparatus according to claim 2, wherein said motion control means comprises:

a slide rod mechanism having a sleeve member attaching to the side walls slidably receiving a first end of a slide rod member, said slide rod member having an opposite end bent at a substantially 90° angle and received in a release bracket supporting said third board member.

* * * * *